US006347730B1

(12) United States Patent
Frederick

(10) Patent No.: US 6,347,730 B1
(45) Date of Patent: Feb. 19, 2002

(54) BACKPACK WITHOUT SIDES

(76) Inventor: Robert J. Frederick, 6577 Vera Cruz Rd., Center Valley, PA (US) 18034

( * ) Notice: Subject to any disclaimer, the term of this patent is extended or adjusted under 35 U.S.C. 154(b) by 0 days.

(21) Appl. No.: 09/631,153

(22) Filed: Aug. 2, 2000

(51) Int. Cl.[7] ..... A45F 3/04

(52) U.S. Cl. ..... 224/259; 224/250; 224/651; 294/150; 294/151; 294/157

(58) Field of Search ..... 224/153, 578 B, 224/580, 627, 651, 250, 259; 294/150, 151, 157

(56) References Cited

U.S. PATENT DOCUMENTS 813,216 A * 2/1906 Karibo
995,458 A * 6/1911 Harriman
1,060,257 A * 4/1913 Humphrey
4,972,981 A * 11/1990 Gex ..... 224/250 X
5,148,956 A * 9/1992 Funk
5,579,966 A * 12/1996 Krumweide et al. .... 224/259 X
5,622,346 A * 4/1997 Stroy, Jr.
5,810,223 A * 9/1998 Helm ..... 224/250
5,918,785 A * 7/1999 Irose ..... 224/259

* cited by examiner

*Primary Examiner*—Gregory M. Vidovich
(74) *Attorney, Agent, or Firm*—Sanford J. Piltch

(57) ABSTRACT

An apparatus for carrying articles on one's back having a bottom and upstanding wall for resting against the back of the user with cooperating strapping systems overlying each other and extending between the bottom and upstanding wall for retaining the articles within the confines of the straps and a transparent sheet protector for overlying the contents to protect the contents from inclement weather.

10 Claims, 4 Drawing Sheets

BACKPACK WITHOUT SIDES

BACKGROUND OF THE INVENTION

The present invention relates to an adjustable backpack without front or side walls, which allows one to view all of the contents contained within it at any given time. More specifically, the backpack prevents the user from concealing weapons or other illegal objects. The backpack has adjustable straps to accommodate the varying sizes of the contents, a rectangular shaped holder at the bottom attached to the straps to provide horizontal support, and an upstanding or vertical support piece attached to both the straps, the shoulder straps and the rectangular holder. The backpack of the present invention may also have a built-in pocket that contains a transparent, waterproof sheet attached through the pocket to the backpack to protect the contents of the pack from inclement weather.

Currently, backpacks are constructed entirely of non-transparent materials, which do not allow the contents of the pack to be readily or easily viewed without opening up and emptying out the backpack. Moreover, since the material is designed to be rigid because it is relied upon for support, the outline or contours of potentially dangerous contents can not be discerned from the outside. As such, in light of the recent rise in school violence and shooting incidents, backpacks have been banned from many schools because the design allows students to conceal weapons in them. However, with many students having upwards of six classes, it is unrealistic and unfair to expect students to carry all of their books, notebooks, writing utensils and calculators around for the entire day without an acceptable carrying means such as a backpack or a bag. Furthermore, students with disabilities are at an even further disadvantage because they are often unable to carry their books around at all without some type of a backpack.

The present invention overcomes these considerable setbacks by providing a novel backpack, which allows students to carry their books to and from school, in addition to using the backpacks within the school to walk from class to class. Thus, the prior concern with students using backpacks to conceal weapons is alleviated by the creation and use of the present invention. More specifically, the present invention is an open backpack, which allows all of the contents to be viewed at all times, while providing the option of using a self-contained, clear, water-proof sheet to protect the contents of the pack from inclement weather. In short, the present invention provides a positive alternative to forcing students to carry cumbersome and weighty books around school in addition to carrying pens, pencils, markers, highlighters, rulers, protractors and calculators, while further providing a safe alternative to all fabric backpacks, which can be used to conceal weapons and the like.

An example of this type of non-transparent, entirely fabric backpack is U.S. Design Pat. No. 403,853 [Lothrop, et al.]. This backpack is bulky and designed entirely of non-transparent fabric. Moreover, the backpack does not provide expandable straps or means to accommodate the varying size of the contents. Another example of closed, fabric constructed backpacks is U.S. Design Pat. No. 404,909 [Fichter]. This backpack, again, provides no means for expansion and actually narrows as it reaches the bottom of the backpack, clearly indicating that it is not designed to adjust for the varying sizes of the contents. Moreover, since the top of the pack is zippered and then has another flap, which covers the zippered opening, the backpack entirely conceals the contents from view.

Yet another example of these types of cumbersome backpacks is U.S. Design Pat. No. 413,015 [Albers]. This backpack appears to be made of non-rigid material and is somewhat expandable, but again has non-transparent, zippered compartments, which entirely obscures the view of potentially dangerous contents contained within the backpack. In another example, U.S. Design Pat. No. 409,376 [Golenz, et al.] teaches a substantially rigid backpack, which provides absolutely no means for expansion, therefore making it impossible to even discern or make out an outline, shape or contour of the contents. Thus, the use of such a backpack poses a significant threat if the user is attempting to conceal a dangerous weapon in the backpack.

U.S. Pat. No. 5,892,962 [Smith, et al.] teaches a stowage system that is designed specifically for flight travel. This system contains several compartments designed to hold a flight bag, a backpack, a backpack adapter, and a pressurized stowage rack. The backpack within the stowage system is a large zippered fabric bag, which allows the user to store many objects. The backpack has a lid, which contains two narrow slits of transparent material that allow only minimal inspection and sight of the contents inside the pack.

In contradistinction, the present invention is entirely open and the contents within the pack are completely visible, even with the clear sheet of water-proof material that is designed to cover all of the contents of the backpack to prevent damage from inclement weather. In addition, the backpack of the present invention expands to conform to the varying size of the contents, such as books and notebooks, within the confines of the straps of the pack while still remaining taut to secure the items in place.

Accordingly, it is an object of the present invention to overcome the prior setbacks associated with non-transparent, rigid, fabric backpacks. The present invention provides an adjustable backpack, which for the first time, is not constricted by fabric and is open so that all the contents secured within the pack may be viewed.

It is a further object of the present invention to protect the contents within the open backpack by providing a self-contained, clear, water-proof sheet that is capable of covering the contents within the backpack.

SUMMARY OF THE INVENTION

The present invention provides a tangible solution to the setbacks of the prior inventions. This invention provides an alternative, particularly to schools, to requiring students and employees to carry around all of their books, notebooks, writing utensils, and calculators by hand, because the school has banned using backpacks since they have been the primary means of hiding weapons brought to school.

More specifically, the present invention is an apparatus without front or side walls that is capable of carrying objects of varying size. It is comprised of an upstanding support member forming the back wall of the backpack, which is attached to the rectangular shaped bottom member. The invention is further comprised of one of more vertical oriented straps attached between the frontmost portion of the bottom member and the topmost portion of the backwall. Additionally, one or more horizontal straps extend between both sides of the backwall, which cooperate with vertical straps to retain the objects in the backpack. The invention also has shoulder straps attached to the backwall of the apparatus as well as a carrying strap attached to topmost portion of the upstanding support.

The invention is also equipped with snap-lock buckles that connect the vertical straps to each other and the horizontal straps to one another. Each strap also contains adjuster, which allows each strap to be lengthened or shortened in their respective orientations. More specifically, the strap adjusters allow the backpack to adjust in size to accommodate the varying sizes of the contents. The straps attach to each other at the point in which the straps intersect and overlie one another.

Alternatively, the vertical strap may have another strap sewn parallel to the front of each strap by way of secure cross stitches such that the overlying horizontal straps are secured within a confined vertical space. The horizontal straps are allowed to move freely within the confined vertical space to provide the fullest range of adjustment and expansion possible, because the horizontal straps adjust independently of the vertical straps, without losing the shape or form of the backpack.

The backpack of the present invention is also equipped with a clear, water-proof sheet that is capable of covering and protecting the contents within the backpack. The sheet is self-contained within a pocket and is attached directly to the backwall of the backpack. The backpack may also contain means to secure the transparent cover in position over the contents of the apparatus as well.

BRIEF DESCRIPTION OF THE DRAWINGS

For the purpose of illustrating the invention, there is shown in the drawings forms that are presently preferred; it being understood, however, that the invention is not limited to the precise arrangements and instrumentalities shown.

Referring now to the drawings in detail, where like numerals refer to like parts or elements, there is shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
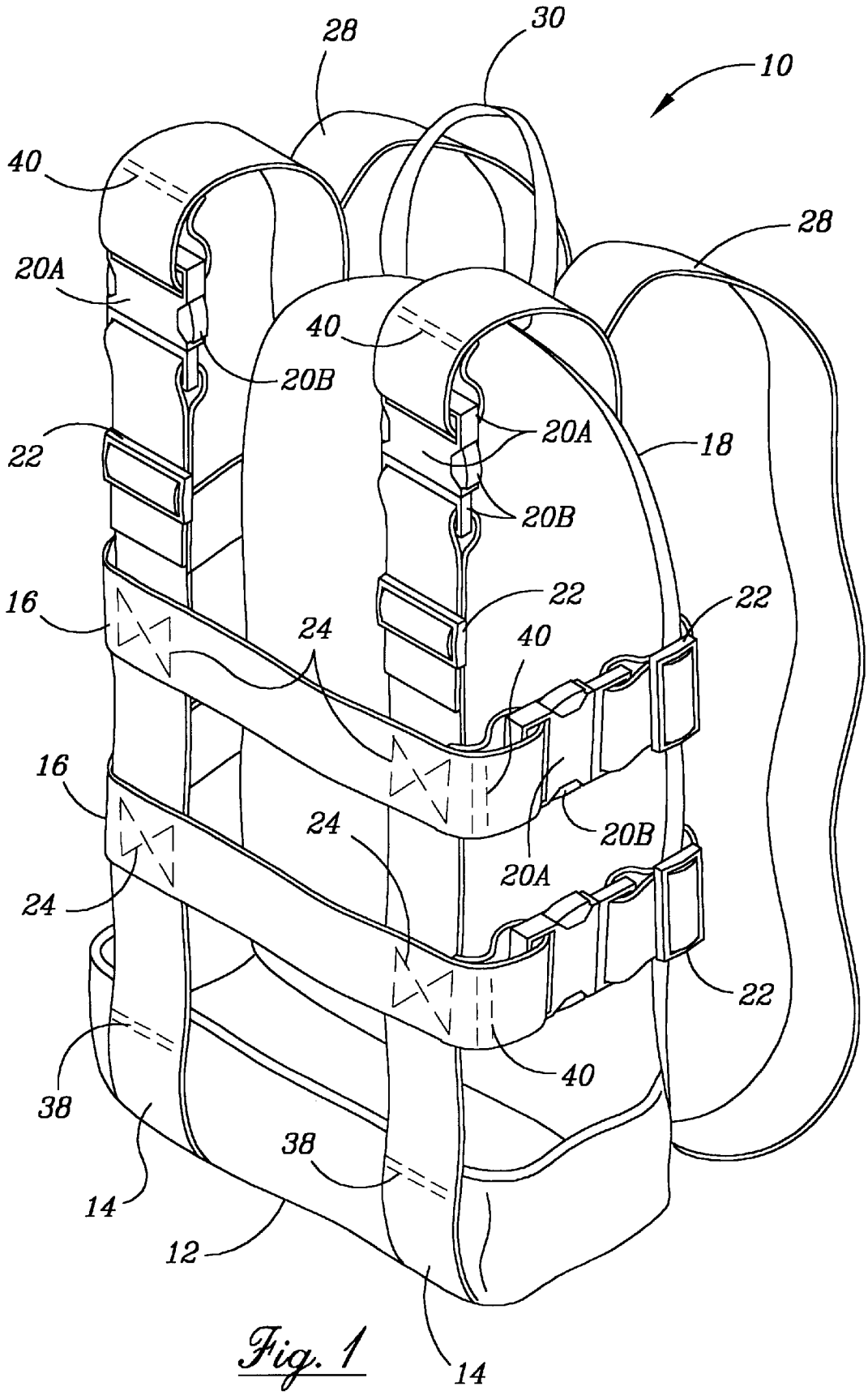
FIG. 1 is a perspective view of the backpack of the present invention.

Referring more particularly to FIG. 1, there is shown backpack 10, comprised essentially of bottom holder 12, vertical straps 14, horizontal straps 16, upstanding support 18, shoulder straps 28 and hand or carry strap 30. Bottom holder 12 is attached to upstanding support 18 and vertical straps 14 via sewn seams 38. Horizontal straps 16 are attached to upstanding support 18 via sewn seams similar to seams 38 (not shown). Horizontal straps 16 and vertical straps 14 are securely attached to each other via sewn cross-seams 24. Straps 14 and 16 are further attached to snap-lock buckle 20 via seams 40. Snap-lock buckles 20 consists of mating piece 20A, which accepts counterpart 20B in the locked position. When pieces 20A and 20B are pushed toward each other, they connect, forming a releasably secure locked position. Snap-lock buckle 20 can be unlocked and released by pressing the wings of counterpart 20B together and simply pulling mating piece 20A and counterpart piece 20B away from each other.

Figure 2:
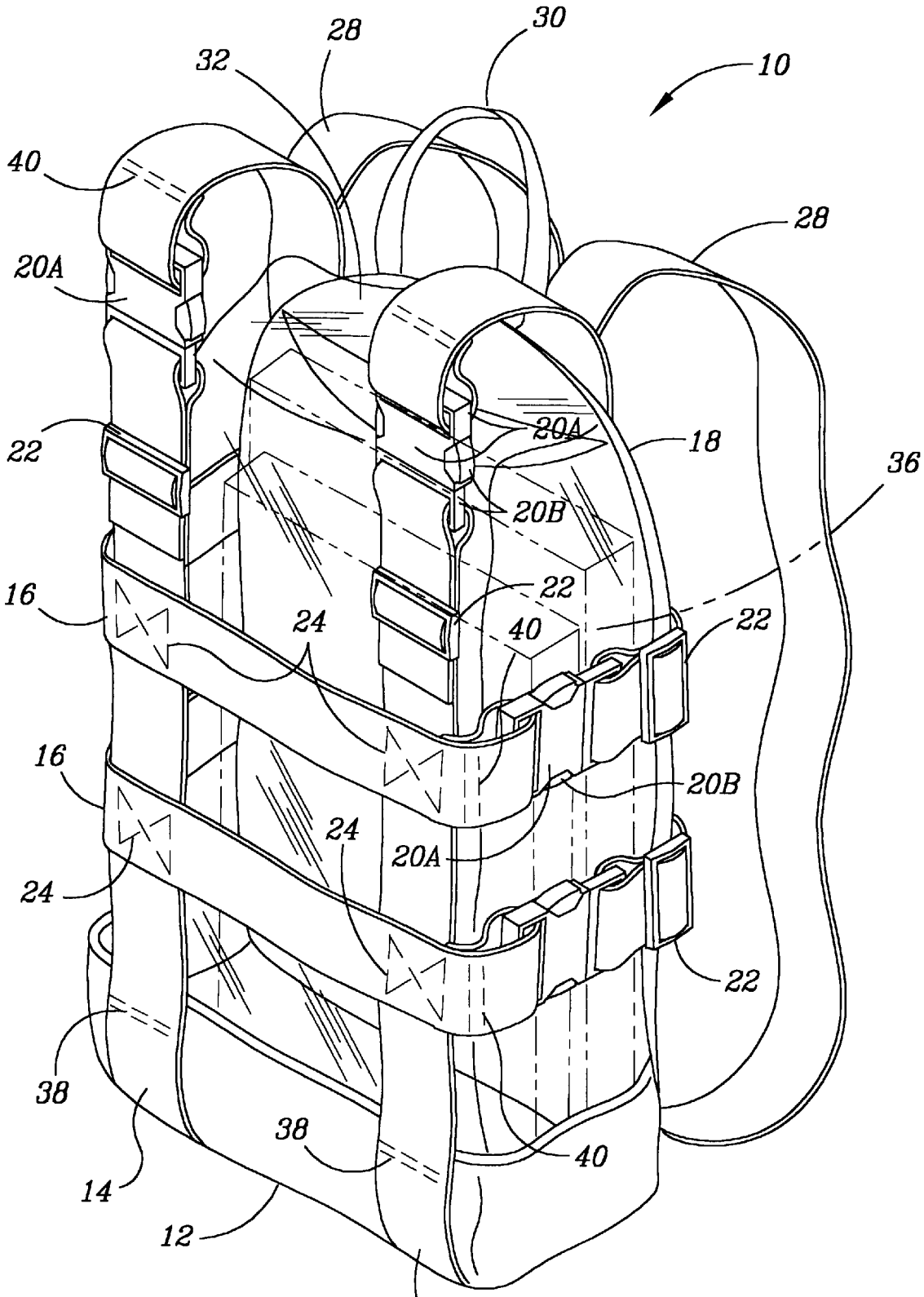
FIG. 2 is a perspective view of the backpack of the present invention with a clear covering between the contents of the backpack and the support structure.
Figure 3:
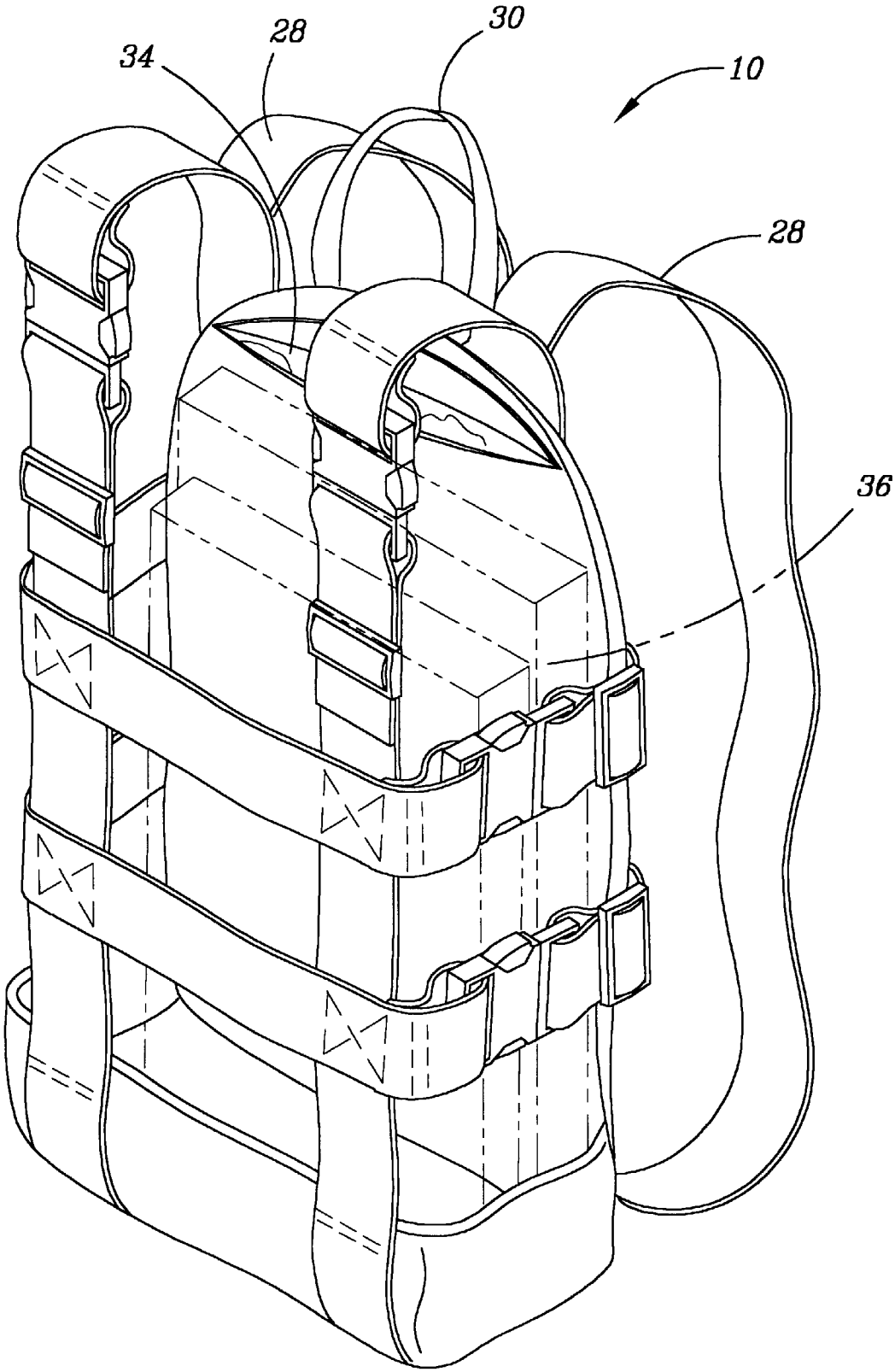
FIG. 3 is a perspective view of the backpack of the present invention showing the pouch containing the protective covering.

Vertical straps 14 and horizontal straps 16 can be adjusted via strap adjuster 22. As such, the straps may be adjusted to accommodate the varying size of the contents contained within backpack 10, such as books 36, as shown in FIGS. 2 and 3. Also shown in FIGS. 2 and 3, is transparent, water-proof protection material 32 and corresponding pocket 34. The pouch or pocket 34 is sized to completely retain the transparent cover 32 when not in use.

Backpack 10 is ideal for school situations because it allows students to carry a backpack to school, but does not allow the student to use the bag to conceal potentially dangerous or fatal weapons. Moreover, during inclement weather, the user may open pouch 34 to unfold and deploy the sheet of transparent, water-proof protection material 32, which is attached through pouch 34 to backpack 10 and covers the contents within pack 10. Sheet 32 extends from the top to the bottom of backpack 10, and has the ability to attach to holder 12 (FIG. 2) by any known means to contain cover 34 in position, e.g. cooperating hook and loop attachments, not shown, which may be attached to the bottom member 12.

Figure 4:
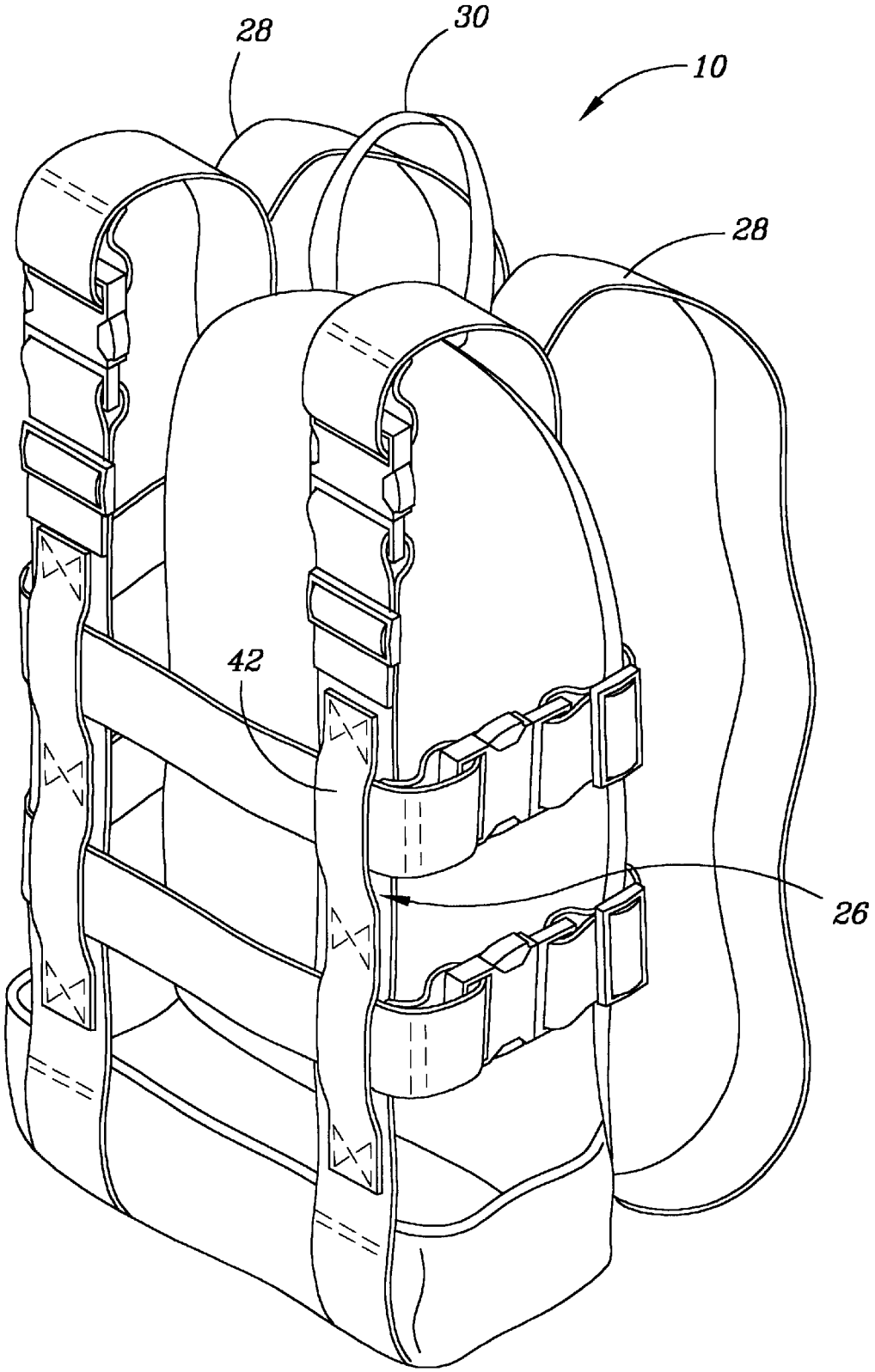
FIG. 4 is a perspective view of the backpack of the present invention showing an alternative orientation of the straps.

Alternatively, vertical straps 14 may be designed so that horizontal straps 16 may move freely within a confined vertical space 26 as shown in FIG. 4. Vertical straps 14 may have another strap 42 sewn parallel to the front of it by way of secure cross-stitches 24 in the manner shown. Thus, horizontal straps 16 are secured within a vertical space 26, but allowed to move in the horizontal direction within the vertical space 26. This is particularly helpful for adjusting the size of backpack 10 and providing the fullest range of adjustment and expansion possible since horizontal straps 16 adjust independently of the vertical straps 14.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraces therein.

I claim:

1. An apparatus without front or sidewalls for carrying differently sized objects comprising: an upstanding support member forming a back wall, which is securely attached to a substantially rectangular shaped bottom member; one or more vertically oriented straps extending between the front-most portion of said bottom member and the topmost portion of said backwall and one or more horizontally oriented straps extending between both sides of said backwall in a forward facing direction for cooperation with said vertically oriented straps in retaining one or more objects within the confines of said straps, wherein said vertically oriented straps being in overlapping contact with said horizontaly oriented straps, said bottom member and said backwall; and shoulder carrying straps attached to said backwall of the apparatus.

2. The backpack of claim 1 wherein a carrying strap is attached to the topmost portion of said upstanding support.

3. The backpack of claim 1 wherein cooperating snap-lock buckles are respectively attached to a first and second section of said vertical straps to releasably secure said sections of the vertical straps one to the other each other.

4. The backpack of claim 1 wherein cooperating snap-lock buckles are respectively attached to a first and second section of said horizontal straps to releasably secure said sections of the horizontal straps one to the other each other.

5. The backpack of claim 1 wherein said horizontally and vertically oriented straps each contain a strap adjuster for lengthening and shortening each of said straps to conform to the size of the contents to be retained within said backpack.

6. The backpack of claim 1 wherein said one or more horizontally and vertically oriented straps are attached to each other at the point in which one of said straps overlaps the other.

7. The backpack of claim 1 wherein said one or more vertically oriented straps have another strap attached in parallel and overlying the front of said straps to the front of each other such that said one or more horizontally oriented straps are retained within a space created between points of attachment so that said horizontally oriented straps are allowed to move freely in the horizontal direction within the created space and move within a limited range in the vertical direction to provide the fullest range of independent adjustment expansion between vertically and horizontally oriented straps.

8. The backpack of claim 1 wherein said backpack further comprises a clear, water-proof sheet capable of covering and protecting the contents within said backpack.

9. The backpack of claim 8 wherein said sheet is self-contained within a pocket and attached directly to said backpack.

10. The backpack of claim 9 that contains means for securing said clear, water-proof sheet to said backpack.

* * * * *